US011192681B2

(12) United States Patent
Hokanson

(10) Patent No.: US 11,192,681 B2
(45) Date of Patent: Dec. 7, 2021

(54) CARTON HAVING MAJOR FLAP OVERLAP

(71) Applicant: Kimberly-Clark Worldwide, Inc., Neenah, WI (US)

(72) Inventor: Brandon Mark Hokanson, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/609,026

(22) PCT Filed: May 30, 2019

(86) PCT No.: PCT/US2019/034526
§ 371 (c)(1),
(2) Date: Oct. 28, 2019

(87) PCT Pub. No.: WO2020/242471
PCT Pub. Date: Dec. 3, 2020

(65) Prior Publication Data

US 2020/0377256 A1 Dec. 3, 2020

(51) Int. Cl.
*B65D 5/66* (2006.01)
*B65D 5/00* (2006.01)
(Continued)

(52) U.S. Cl.
CPC ..... *B65D 5/6626* (2013.01); *B65D 5/001* (2013.01); *B65D 5/0227* (2013.01);
(Continued)

(58) Field of Classification Search
CPC .... B65D 5/6626; B65D 5/001; B65D 5/0227; B65D 5/0254; B65D 5/103; B65D 5/2057; B31B 50/732
(Continued)

(56) References Cited

U.S. PATENT DOCUMENTS 4,260,100 A * 4/1981 Hoffman ..... B65D 5/0254 229/109
4,548,593 A 10/1985 Tisma
(Continued)

FOREIGN PATENT DOCUMENTS

| | | |
|---|---|---|
| EP | 2292516 B1 | 3/2013 |
| JP | 11278461 A2 | 10/1999 |
| JP | 3170254 U | 9/2011 |

OTHER PUBLICATIONS

Printpapa, "Full Overlap Slotted Container (FOL)", 2018.

*Primary Examiner* — Christopher R Demeree
(74) *Attorney, Agent, or Firm* — Kimberly-Clark Worldwide, Inc.

(57) ABSTRACT

Provided are cartons, particularly cartons for storing and dispensing consumer products and more particularly absorbent consumer products and still more particularly tissue products, such as rolled tissue products, which eliminates plastic packaging while still protecting the carton contents from dirt and grime. The carton contents are protected by providing a carton having a top panel formed from opposing flaps that overlap to some extent. The overlapped portion however, is designed to compress on center and not to add material height to the perimeter of the carton so that multiple cartons may be stacked one on top of another to form a stable unit load.

18 Claims, 11 Drawing Sheets

(51) Int. Cl.

| | |
|---|---|
| ***B65D 5/02*** | (2006.01) |
| *B31B 120/70* | (2017.01) |
| *B31B 120/10* | (2017.01) |
| *B31B 120/30* | (2017.01) |
| *B31B 50/00* | (2017.01) |
| *B31B 50/62* | (2017.01) |
| *B31B 110/35* | (2017.01) |
| *B31B 50/20* | (2017.01) |

(52) U.S. Cl.
CPC ..... *B31B 50/003* (2017.08); *B31B 50/20* (2017.08); *B31B 50/624* (2017.08); *B31B 2110/35* (2017.08); *B31B 2120/102* (2017.08); *B31B 2120/302* (2017.08); *B31B 2120/70* (2017.08)

(58) Field of Classification Search
USPC ..... 229/132, 155, 185, 222
See application file for complete search history.

(56) References Cited

U.S. PATENT DOCUMENTS

| | | | | |
|---|---|---|---|---|
| 4,723,658 | A | 2/1988 | Steel | |
| 5,878,946 | A * | 3/1999 | Frerot | B65D 5/46192 229/117.13 |
| 6,202,920 | B1 | 3/2001 | Auclair | |
| 7,285,082 | B1 * | 10/2007 | Walker | B65D 5/742 229/219 |
| 7,731,080 | B2 | 6/2010 | Zacher et al. | |
| 8,459,537 | B2 * | 6/2013 | Moglia | B65D 5/10 229/158 |
| 8,628,000 | B2 | 1/2014 | Spivey, Sr. et al. | |
| 9,132,936 | B2 | 9/2015 | Kohler | |
| 9,617,030 | B2 | 4/2017 | Guardiola | |
| 9,957,085 | B2 | 5/2018 | Bourdin et al. | |
| 10,076,887 | B2 | 9/2018 | Aganovic et al. | |

* cited by examiner

CARTON HAVING MAJOR FLAP OVERLAP

BACKGROUND

Consumer packaged goods, particularly absorbent articles and tissue products, are often packaged in fully sealed packaging to avoid infestation of dirt and grime. In certain instances, the packaging may comprise a paperboard carton having ends that are sealed by folding together four flaps. One such carton is the regular slotted container (RSC) and is illustrated in FIG. 1. The outer flaps are of equal width and generally one-half of the carton width, which allows the outer flaps to abut one another, but not overlap, when folded to form the carton. The inner flaps are of generally equal length and generally less than one-half of the box length, such that they do not abut one another when folded to form the carton, leaving a gap between the folded flaps.

Another common folded carton is the overlap slotted container (OSC) which, like the RSC, has a carton top formed from four folded flaps. One type of OSC is illustrated in FIG. 2. The top of the OSC is formed from a pair of similarly sized opposed outer flaps and a pair of similarly sized opposed inner flaps. However, unlike the RSC, the width of the outer flaps is generally greater than half the width of the carton such that, when folded, the top flaps overlap one another. The overlap portion generally has a length dimension that is equal to the length of the outer flaps. In certain instances, the overlapped portion may be provided with a sealing means, such as an adhesive or mechanical fastener to secure the carton in a folded configuration.

Variations on the OSC have been proposed to improve carton durability and stackability. For example, the inner and outer flaps may be cut to different dimensions to enable the inner flaps to abut one another, avoiding any gap between the flaps when folded into a carton. This type of carton is often referred to as a center special slotted container (CSSC) and is illustrated in FIG. 3. In other instances, the inner flaps may be cut to abut one another, as in the CSSC, but the outer flaps may be sized to fully overlap one another when folded into a carton. This type of carton is often referred to as a center special full overlap slotted container (SFF) and is illustrated in FIG. 4.

In certain instances, one of the outer flaps forming the carton top may be provided with a tab portion to facilitate opening and resealing of the carton. Tabs are commonly employed where the outer flaps overlap one another, such as in the cartons illustrated in FIGS. 5 and 6. In both of the illustrated cartons, the cartons are generally overlap slotted containers where one of the outer flaps has been provided with a tab and the opposing outer flap has been provided with a means for retaining the tab after the carton is opened, such as slot (as illustrated in FIG. 5B) or a cut out shaped to receive the tab and interlock the flaps (as illustrated in FIG. 6B). Regardless of the tab retention mechanism, each of the cartons have outer flaps overlap one another along both the tab portion and the flap portion adjacent to the tab such that the overlapped portion generally has a length that is equal to the length of the outer flap.

While the foregoing cartons provide good sealing of carton contents, there remains a need for a carton which is capable of providing improved sealing, may provide efficient use of the interior volume of the carton, may be stackable, and may be readily manufactured.

SUMMARY

The present invention provides a carton, particularly a carton for storing and dispensing consumer products and more particularly absorbent consumer products and still more particularly tissue products such as rolled tissue products, which eliminates plastic packaging while still protecting the carton contents from dirt and grime. The carton contents are protected by providing a carton having a top panel formed from opposing flaps that overlap to some extent. The overlapped portion however, is designed to compress on center and not to add material height to the perimeter of the carton so that multiple cartons may be stacked one on top of another to form a stable unit load.

Accordingly, in one embodiment the present invention provides a carton having a folded top panel, a top panel perimeter and a carton height, the top panel formed from four folded flaps—a pair of opposed major top flaps and a pair of opposed minor top flaps—where one of the major top flaps has a tab. The tab is sized such that then the first and second major flaps are folded closed the tab overlaps at least portion of the opposing major top flap. While the tab overlaps a portion of the opposing top flap, the overlap generally occurs near the center of the carton such that the carton height is relatively uniform about the entirety of the carton perimeter.

In another embodiment the present invention provides a carton having a longitudinal dimension, a transverse dimension, opposed top and bottom panels, opposed first and second side panels and opposed first and second end panels, the carton comprising: a first major top flap having opposed first and second lateral edges and a tab, a second major top flap having first and second opposed lateral edges, and first and second minor top flaps, wherein the tab at least partially overlaps a portion of the second major flap and wherein the first and second major top flap lateral edges do not overlap one another.

In still another embodiment the present invention provides a carton having a bottom panel, a top panel, a top panel perimeter edge and a carton height, the carton comprising first and second major top flaps folded to form the top panel wherein the height of the carton about the entirety of the perimeter edge is substantially uniform and wherein the first and second major top panels do not overlap one another along any portion of the perimeter edge.

In yet another embodiment the invention provides a carton having a longitudinal dimension, a transverse dimension, opposed top and bottom panels, opposed first and second side panels and opposed first and second end panels, the carton comprising: a first major top flap having opposed first and second lateral edges and a tab having a length dimension (TL), a width dimension (TW) and a tab area (TA), a second major top flap having first and second opposed lateral edges and a recess having a length dimension (RL), a width dimension (RW) and a recess area (RA), and first and second minor top flaps, wherein the tab at least partially overlaps the recess and a portion of the second major flap and wherein the first and second major top flap lateral edges do not overlap one another.

DETAILED DESCRIPTION

Figure 1:
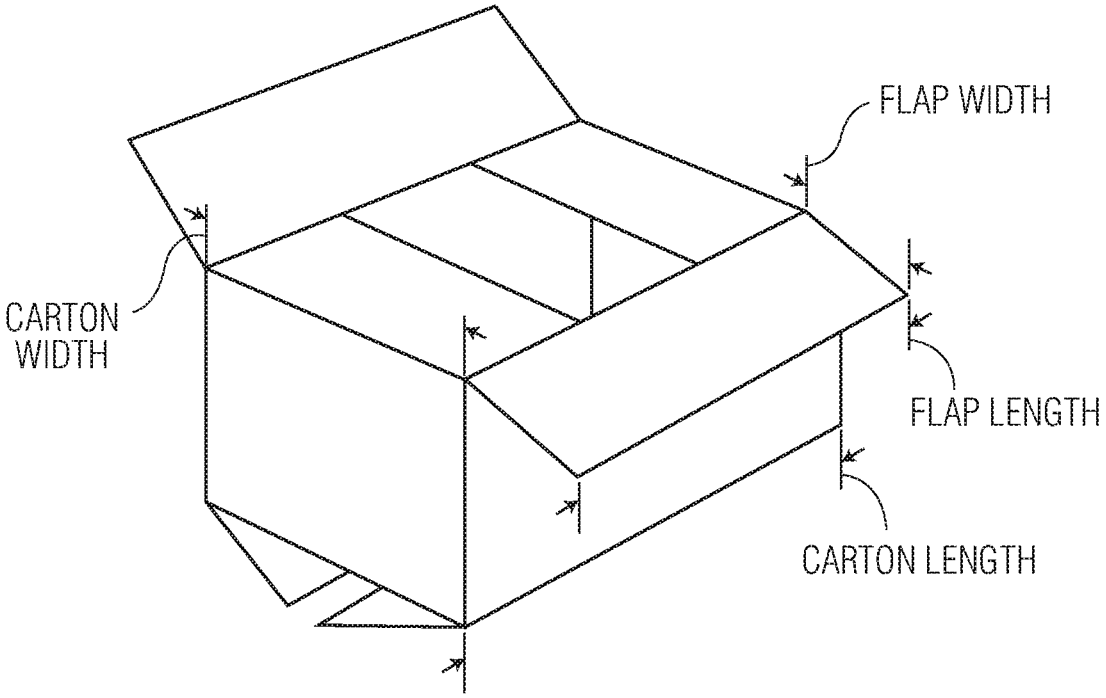
FIG. 1 PRIOR ART
FIGS. 1, 2, 3, 4, 5A, 5B, 6A and 6B illustrate various prior art cartons.
Figure 2:
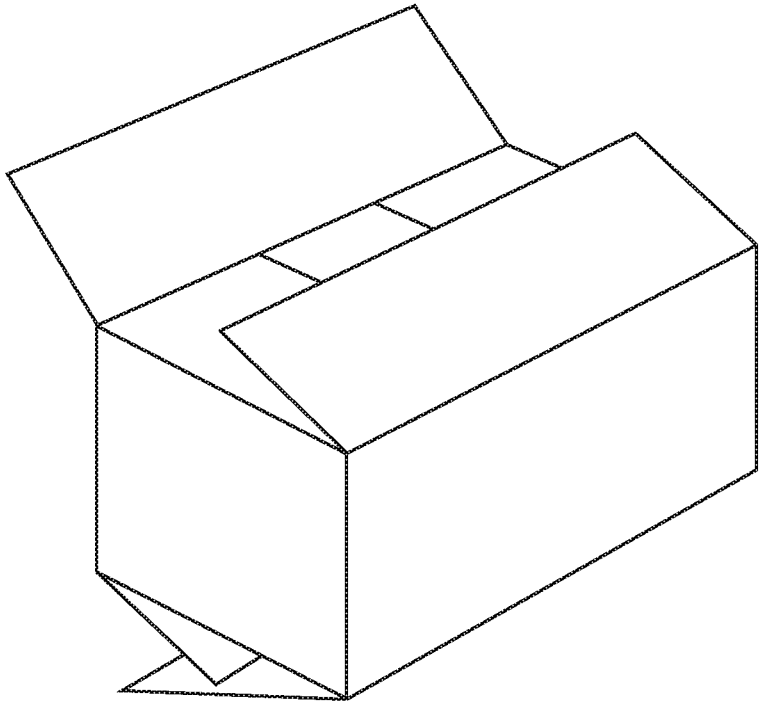
FIG. 2 PRIOR ART
Figure 3:
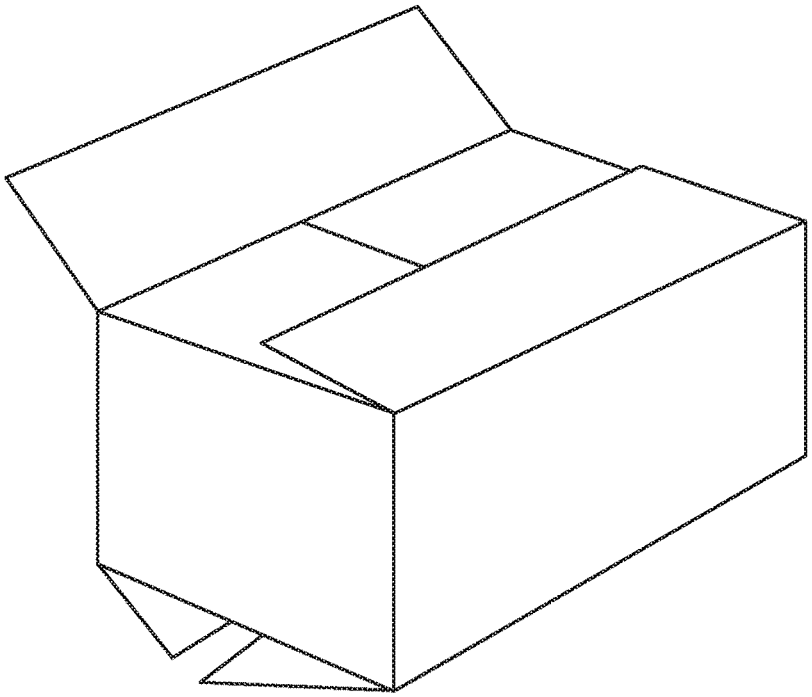
FIG. 3 PRIOR ART
Figure 4:
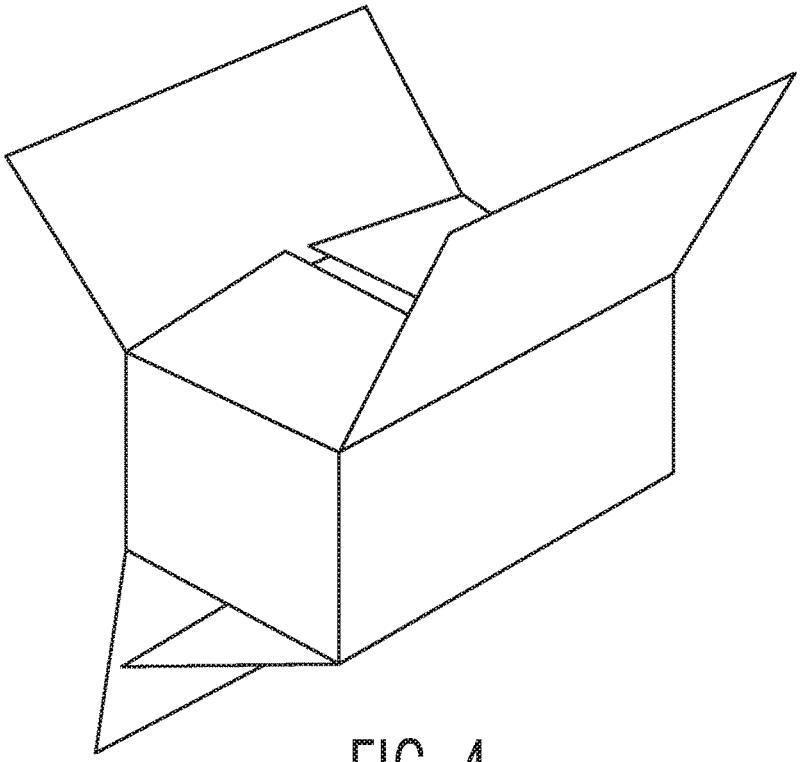
FIG. 4 PRIOR ART
Figure 5A:
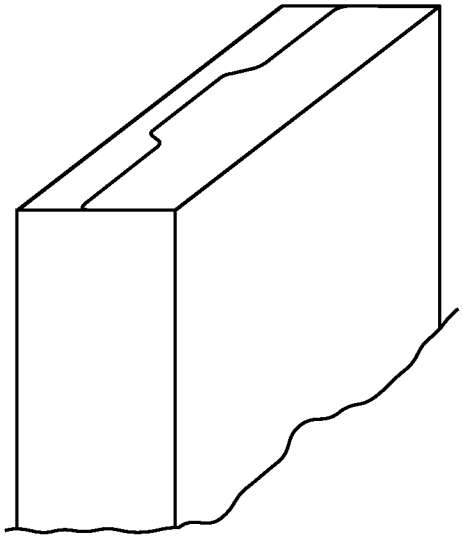
FIG. 5A PRIOR ART
Figure 5B:
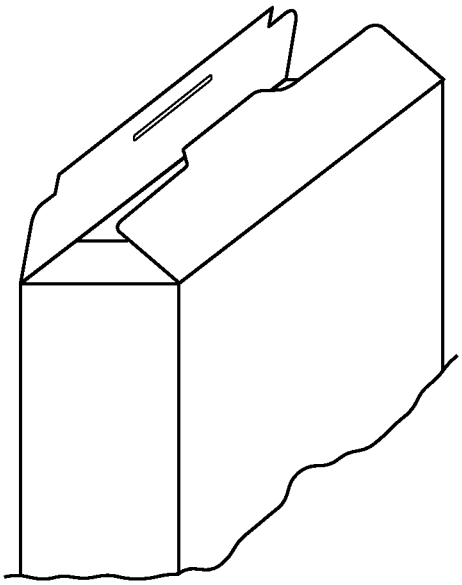
FIG. 5B PRIOR ART
Figure 6A:
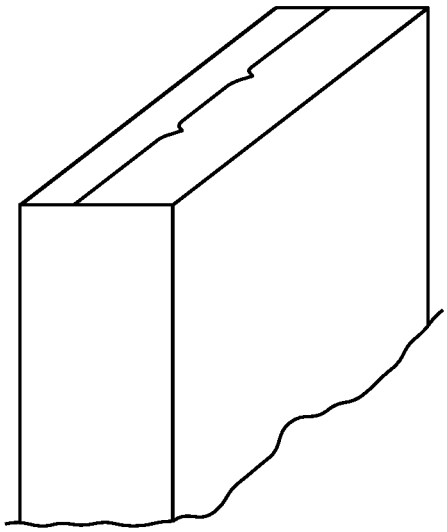
FIG. 6A PRIOR ART
Figure 6B:
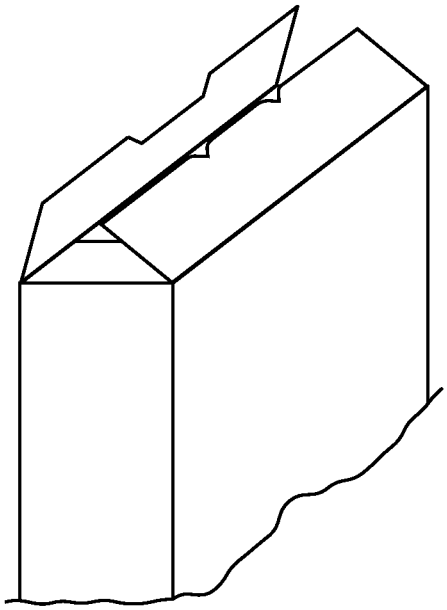
FIG. 6B PRIOR ART

A carton for purposes herein will have six discernable "sides" (front, left, right, top, bottom, rear) and will be box-like or cuboid in overall shape. The spatial orientation used herein is such that the "bottom" of the fully erected carton refers to the panel that will be in contact with another surface, such as a stationary surface, such as a store shelf or on a shelf in a consumer's home, or another carton when in stacked configuration. Correspondingly, the "top" of the present carton refers to the uppermost panel of the carton when the carton is standing upright with the bottom contacting a surface and is the panel of the carton where an access to the interior of the carton exists. "Rear" and "back" are terms that may be used interchangeably to refer to that panel of the box opposite the front panel and not visible when the carton is viewed at the front plan. When viewing the front plan of the erected carton (i.e. viewing the carton face-on), the side to the right is herein designated the "right side panel" and the side to the left is herein designated the "left side panel."

Throughout the disclosure "panel" and "flap" may be used interchangeably as primarily flat, rigid, structural elements that are mutually contiguous and that collectively form the overall cuboid structure of the carton when the carton is erected, although where possible, panel refers to a larger and substantially visible portion of the carton and flap to a smaller functional portion such as a minor flap that may not be visible from the exterior of the carton once erected. Any side to the erected carton (e.g. "top", "left side", "right side", "front," "rear," or "bottom") may be comprised of multiple separate panels and/or flaps, (i.e., any side to the present erected carton may be comprised of overlapping layers of panels for added strength and/or ease in gluing). For example, in certain embodiments the top and bottom panels of an erected carton may be formed from folded major and minor flaps.

The nature of the product that may be contained within the carton of the present invention is immaterial to the scope of the present invention, although it is preferred that the present carton be used to contain consumer goods, particularly absorbent products, and more particularly tissue products, such as folded or rolled tissue products, that may be used immediately upon removal from the carton. In this way, the carton of the present invention, may have panels that are entirely sealed and prevent the ingress of contaminants such as dirt and dust. Further, by providing a fully sealed carton, the carton contents may be packaged and shipped without the use of additional packaging materials, such as plastic films that are commonly used to overwrap and protect consumer goods, particularly tissue products.

The term "blank" used herein refers to a flat board/sheet that is cut to a pattern that may be erected into a carton structure. In certain embodiments the blank may be a flat piece of corrugated board that has various cut lines and fold lines such that a machine (called a conversion machine or a carton erector) can build it into a 3-dimensional carton. Such blanks may also be cut with perforated lines that may outline locations where the erected box can be opened at a future time. Perforated lines may allow removal of a flap, the opening of a handle or grasping aperture, or may define a tear strip to open a sealed carton. Alternatively, perforations may outline entire sections of a box intended to be fully removed at some point and may even run the length of the blank (and hence, circumscribe the entire erected box) so that the entire box can be separated into portions along that perforated line. Perforations in general allow for the ripping, tearing or breaking of the corrugated or paper board along the line that is comprised of perforations. Perforations may be small notches, small cuts, or holes, or combinations thereof, and may be pierced or cut through one side or both sides of the corrugated board. For example, a perforated line that may be torn may comprise a series of small linear cuts lined up end to end with a particular spacing between the cuts.

Blanks represent a convenient and collapsed form of a box that may be stacked, bundled and shipped to the manufacturer of the product that is to be placed therein for storing, shipping and merchandising. A die-cut machine cuts card or paperboard or corrugated board into a blank that has a pattern such that the manufacturer can fold it up and glue it into the box shape, readying it for filling with product. Such processes and machines used for cutting, scoring and perforating card, paperboard and corrugate board into intricate blanks for box construction are well known in the art.

In regard to the materials of construction, the carton of the present invention may be constructed of various paperboard, cardboard, corrugated board, sheet metal, or wood paneling, or combinations of these materials, with relatively thin paperboard or cardboard being preferred over corrugate. The blanks that will be described below are preferably manufactured from white cardboard. Corrugated board may be constructed by sandwiching and gluing fluted corrugating medium between layers of white, mottled-white or brown paper liner or paperboard. The choice of white, mottled-white, or brown paper for the corrugated board depends on what the carton is to be used for. The present carton may be constructed of post-consumer waste/recycled materials or new materials as desired, with varying thicknesses depending on cost, desired weight and strength, balanced with environmental responsibility.

As used herein, the term "affixation" generally refers to the attachment of flaps and panels to one another for the purpose of erecting a flat blank into a final carton. Affixation may be carried out using any one of a number of well-known fasteners such as, for example, glue, staples, or tape, or combinations thereof. In this regard, where "glue" or "gluing" is stated herein, other substitute/additional means of affixing flaps and panels to one another, (such as stapling and taping), is within the scope of the invention. Likewise, a "glue flap" may be secured to another panel by staples or tape rather than glue.

Figure 7:
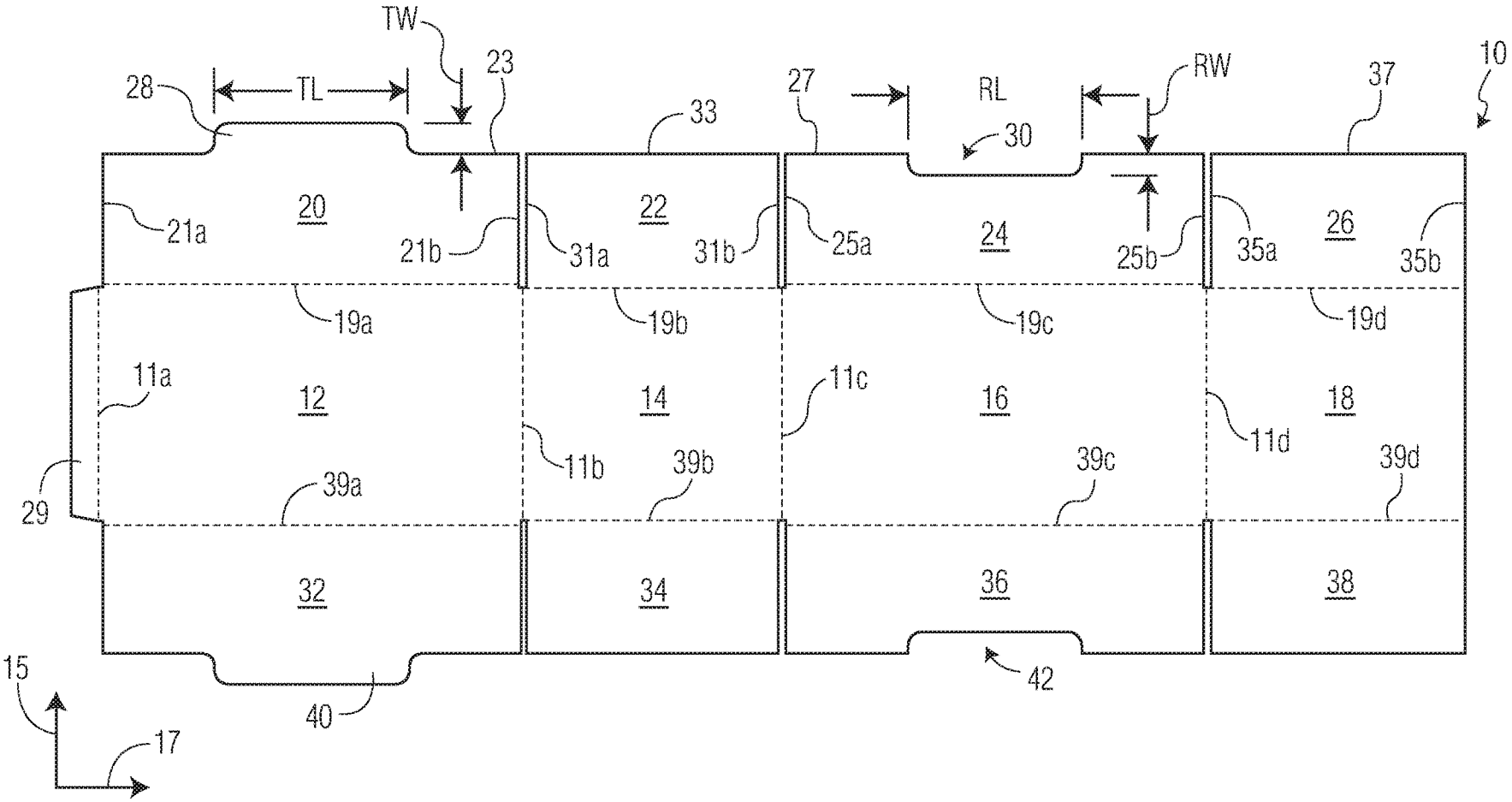
FIG. 7 is a top plan view of a blank according to one embodiment of the present invention.

The carton of the present invention may be formed from a foldable sheet material, such as paperboard, such as the blank illustrated in FIG. 7. The blank 10, which generally has a transverse direction and 15 and a longitudinal direction 17, includes a first side panel 12, a first end panel 14, a second side panel 16, a second end panel 18 and a glue flap 29. These are hingedly coupled together along fold lines 11*a-d*, which extend in a generally transverse direction 15. A series of top end closure flaps—first and second major top flaps 20, 24 and first and second minor top flaps 22, 26—are respectively hingedly connected to the tops of the panels along respective longitudinally extending fold lines 19*a-d*. Similarly, a series of bottom closure flaps—first and second major bottom flaps 32, 36 and first and second minor bottom flaps 34, 38—hingedly extend from the bottom of these panels along respective longitudinally extending fold lines 39*a-d*.

The flaps forming the top or bottom of the carton are generally disconnected from one another to form transversely extending lateral side edges. Further, the distal ends of the flaps generally form a longitudinally extending flap edge. For example, the first major top flap 20 has first and second transversely extending lateral edges 21*a*, 21*b* and a longitudinally extending flap edge 23. The other top flaps have similar shapes and edges, such as a first minor top flap 22 having first and second lateral edges 31*a*, 31*b* and longitudinal edge 33, a second major top flap 24 having first and second lateral edges 25*a*, 25*b* and longitudinal edge 27, and a second minor top flap 26 having first and second lateral edges 35*a*, 35*b* and longitudinal edge 37.

As seen in FIG. 7, the length of the end panels 14, 18 are substantially equal and generally less than the length of the side panels 12, 16 so that when folded into a multi-sided carton having a rectangular configuration, the length of the carton is greater than its width. The dimensions of the panels however, is not limiting and in certain alternate embodiments the panels may be similarly sized to form a multi-sided carton having a square configuration.

Further, as will be appreciated by one of ordinary skill in the art, the blank of FIG. 7 illustrates only one embodiment of a blank useful in forming an enclosed carton having a substantially cubic shape. In other embodiments a carton useful in the invention may be formed from a blank having a second side panel which is connected by a fold line to a glue flap. To form the foregoing blank into a carton, the glue flap is secured to the first side panel, such as by gluing, or the like. The major and minor bottom flaps may then be folded to form a closed bottom and the contents to be packaged are loaded into the carton and the carton is closed by folding and securing the minor and major top flaps extending from the side and panels.

Regardless of the exact configuration of the blank, the blank and resulting carton comprise major flaps that are shaped and configured to provide compression on the center major overlap. That is one of the major flaps has a tab portion extending therefrom and the other major flap has a recess. When folded the tab portion overlaps the opposing major flap and a portion of the tab overlays the recess. While the tab portion forms an overlap, preferably near the mid-point of the top panel, there is no overlap between the lateral edges of the panels.

For example, with reference again to FIG. 7, the blank 10 comprises a first major top flap 20 having a tab 28 extending therefrom. The tab 28 extends generally transversely from the major top flap 20 and has a tab length (TL) generally oriented in the longitudinal direction and a tab width (TW) generally oriented in the transverse direction. In certain preferred embodiments the tab 28 is disposed equal distance between the major flap lateral edges 21*a*, 21*b* and has a rectangular shape with the length (TL) being greater than the width (TW). While illustrated tab has a rectangular shape, one skilled in the art will appreciate that the tab may have any number of different shapes such as, for example, rectangular, square, triangular, oval or tear drop.

With continued reference to FIG. 7, the second major top flap 24 has a recess 30, which is generally formed by removing a portion of the flap. The recess 30 has a recess length (RL) and recess width (RW) and may be disposed equal distance between the major flap lateral edges 25*a*, 25*b*. The recess 30 may have a shape similar to the tab 28, or it may be differently shaped. For example, the tab 28 and recess 30 may both be rectangular having a length that is greater than the width. Just as the shape of the tab is non-limiting, however, the shape of the recess is non-limiting and may take any number of different shapes. In certain instances, the recess may be shaped similarly to the tab or may be shaped to optimize the degree of overlap and the desired amount of compression in the center of the folded carton top. In certain instances, it may be preferable that the recess width (RW) is less than the tab width (TW) such that when the first and second major top flaps 20, 24 are folded to form the carton the tab 28 overlaps the second major top flap 24, while a portion of the tab 28 overlies the recess 30.

While the dimensions of the recess and the tab may vary, in certain instances it may be desirable that the area of the tab be greater than the area of the recess. For example, in one embodiment the tab may have length dimension (TL), a width dimension (TW) and a tab area (TA). The recess may also have a length dimension (RL), a width dimension (RW) and a recess area (RA) where tab area (TA) is greater than the recess area (RA). In other instances, the overlapped portion may have a length dimension (OL), a width dimension (OW) and an overlapped portion area (OA), wherein the tab width (TW) is greater than the recess width (RW) and the overlap area (OA) is less than the tab area (TA).

In a particularly preferred embodiment the overlapped portion area (OA) is from about 20 to about 40 percent of the tab area (TA), such as from about 25 to about 35 percent of TA. In other embodiments the recesses width (RW) is less than the tab width (TW), such as from about 60 to about 70 percent of tab width.

In certain preferred embodiments the bottom flaps may be similarly shaped to the top flaps. For example, as illustrated in FIG. 7, the first and second major bottom flaps 32, 36 and the first and second minor bottom flaps 34, 38 may be similarly sized and shaped to their corresponding top flaps. In this manner the first major bottom flap 32 may be provided with a tab 40 and the second major bottom flap 36 may be provided with a recess 42. Further, the minor flaps 34, 38 may have a length that is similar to the major flap 32, 36, but a shorter transverse dimension (width), such that when the carton is erected the minor bottom flaps 34, 38 are spaced apart from one another.

While it may be desirable to form a blank having similarly shaped and sized top and bottom flaps, the invention is not so limited. In alternate embodiments the bottom flaps, and particularly the bottom major flaps may not be provided with a tab or recess, but rather have a rectangular shape.

Figure 8:
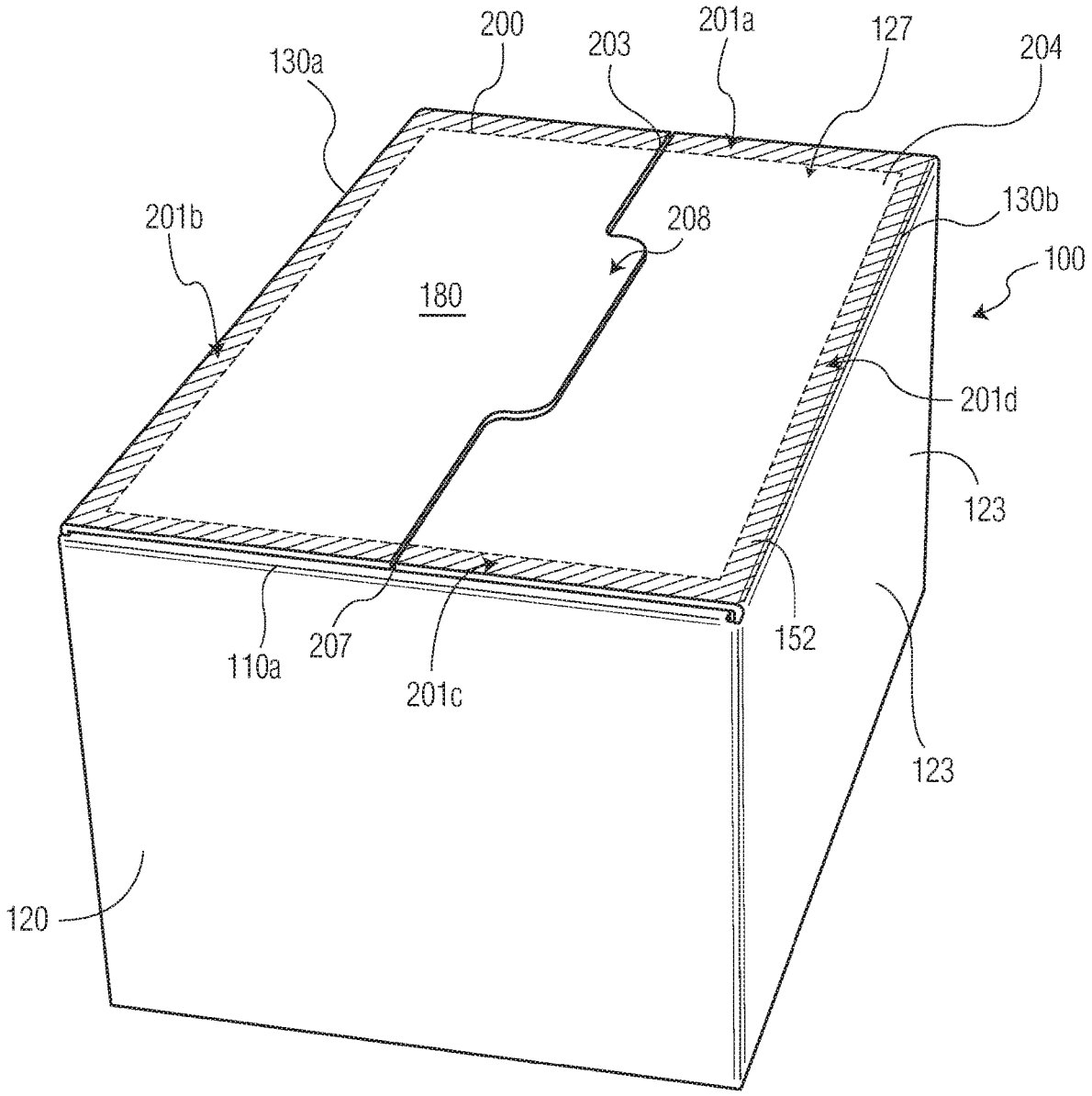
FIG. 8 is a perspective view of a carton according to one embodiment of the present invention in a closed configuration.

With reference now to FIG. 8, an erected carton 100 according to one embodiment of the present invention is illustrated. The carton 100 is generally cubic and has a pair of opposed end panels (end panel 120 visible in FIG. 8), opposed front and back panels (front panel 123 visible in FIG. 8) and opposed top and bottom (top 127 visible in FIG. 8). The carton top 127 is formed from a pair of folded major top flaps 200, 204 folded along first and second folded edges 130*a*, 130*b*. The major top flaps 200, 204 have lateral edges 201*a*, 201*b*, 201*c*, 201*d* that form the upper most lateral edges of the carton 100 when the major top flaps 200, 204 are folded flat. A tab 208 extends from the first major top flap 200 and overlaps a portion of the second major top flap 204.

The carton has an upper surface 180 formed by the major top flaps 200, 204 and an upper carton surface perimeter 152. The perimeter 152 is bounded along its lateral edges of the carton by the major flap lateral edges 201*a*, 201*b*, 201*c*, 201*d*. Preferably the major top flaps 200, 204 do not overlap one another at any point about the perimeter 152. Rather than overlap, the first and second major top flap longitudinal edges 203, 207 abut one another or are slightly spaced apart from one another. In this manner the carton height may be generally uniform along the entire perimeter of the carton.

Figure 9:
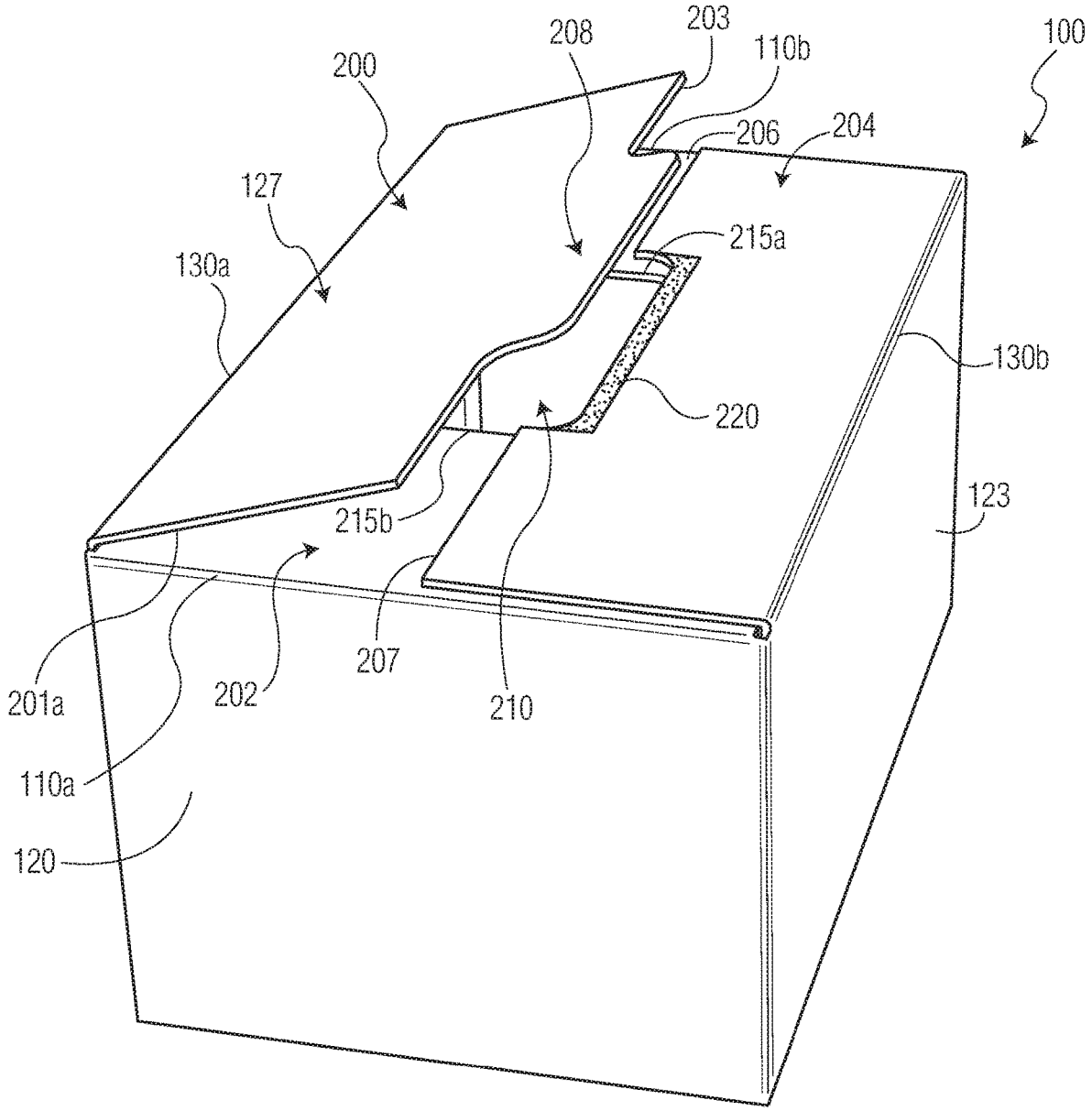
FIG. 9 is a perspective view of a carton according to one embodiment of the present invention in a partially opened configuration.

With reference to FIG. 9, four flaps—first and second major flaps 200, 204 and first and second minor flaps 202, 206—are folded together to form the carton top 127. The first and second major flaps 200, 206 are in folded connection with the front and back panels (back panel 123 visible in FIG. 9) via first and second longitudinally extending fold lines 130*a*, 130*b*. In this manner, the first and second major flaps 200, 204 have a length dimension, extending in a longitudinal direction, that is substantially equal to the length of the front and back panels. The folded first and second major flaps 200, 204 also have a width dimension, extending in a transverse direction.

With continued reference to FIG. 9, the first major flap 200 has a tab 208 extending therefrom. Opposite of the tab 208 the second major flap 204 is provided with a recess 210. The width of the tab 208, that is the transverse dimension, is such that it extends over the recess 210 and contacts the second major top flap 204 along an overlap area 220 (shaded portion of second major top flap 204) when the major top flaps 200, 204 are folded to close the carton 100. In certain instances, the tab 208 may be secured to the second major top flap 204 along the overlap portion 220 by an adhesive, or other fastening means, to secure and seal the carton 100.

Apart from the tab 208, the first major top flap 200 generally does not overlap the second major top flap 204. Rather, when the major top flaps 200, 204 are folded to close the carton top 127, the first and second major top flap longitudinal edges 203, 207 abut one another or are slightly spaced apart from one another. In this manner the carton has an upper perimeter that is monoplanar.

The carton 100 further comprises folded first and second minor flaps 202, 206, which are in folded connection with the back and front panels (back panel 123 visible in FIG. 9) via first and second transversely extending fold lines 110*a*, 110*b*. The first and second minor flaps 202, 206 terminate, opposite the first and second transversely extending fold lines 110*a*, 110*b* at first and second minor flap edges 215*a*, 215*b*. The length, generally extending in a longitudinal direction, of the first and second minor flaps 202, 206 is such that the first and second minor flap edges 215*a*, 215*b* are spaced apart from one another when the flaps are folded to close the top of the carton. The distance between the first and second minor flaps, particularly in relation to other carton components, such as the tab and the recess, will be discussed in more detail below.

Figure 10A:
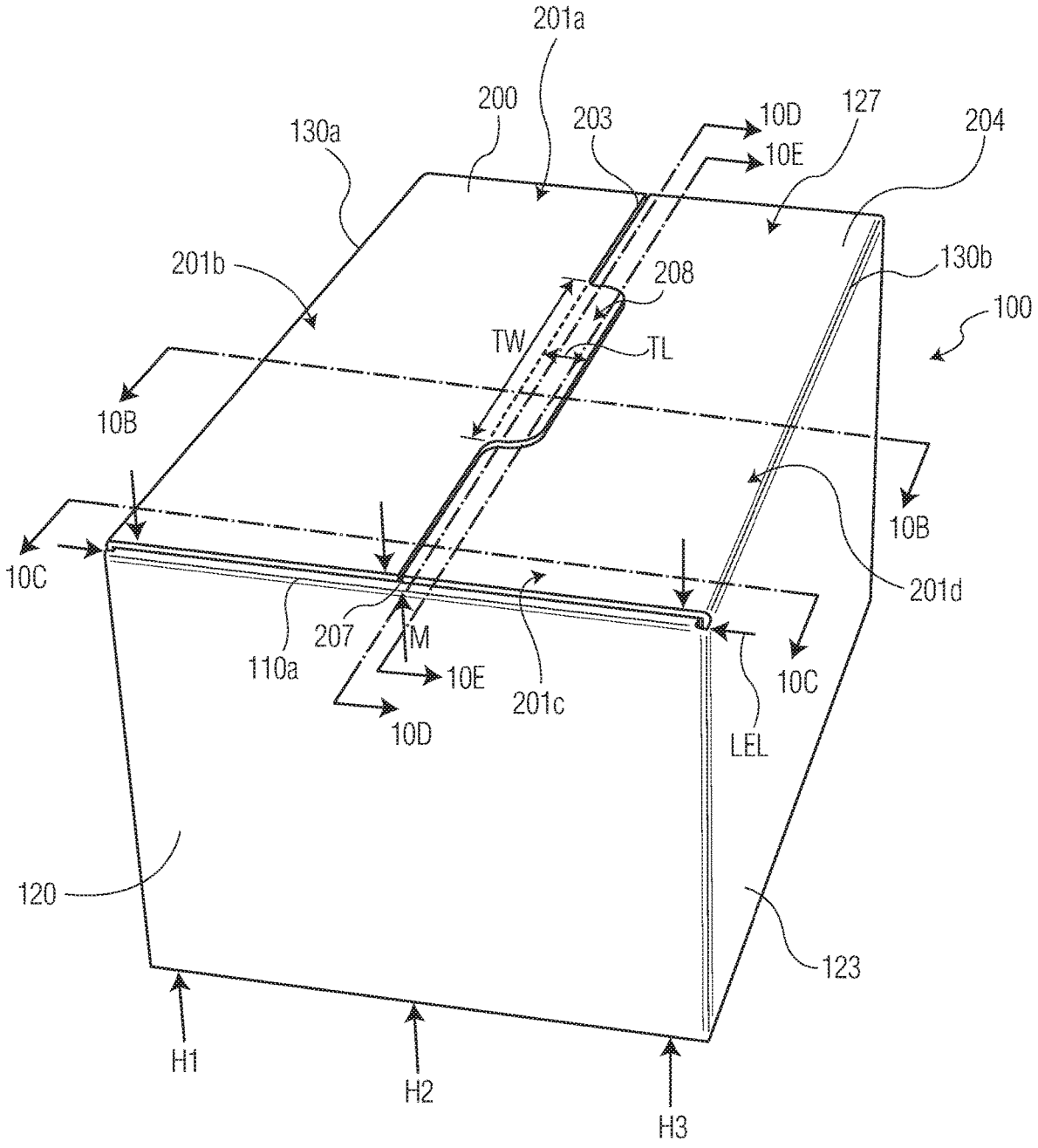
FIG. 10A is another perspective view of a carton according to one embodiment of the present invention in a closed configuration

With reference now to FIG. 10A, which illustrates the carton 100 with the top 127 in a folded and closed configuration, has an upper perimeter defined by the first and second major top flap lateral edges 201*a-d*. In the illustrated embodiment the lateral edge 201*c* contacts the minor flap fold 110*a* along its entire lateral edge length (LEL). The first and second major top flaps 200, 204 are similarly sized and have longitudinal edges 203, 207 that abut one another near the midpoint (M) of the carton lateral edge 201*c*. The first and second major top flaps 200, 204 generally do not overlap one another except for the tab 208 overlapping a portion of the second major flap 204. As discussed previously, the tab portion 208 has a transversely extending tab length (TL) and a longitudinally extending tab width (TW), where TL is greater than the length of the recess (not visible in FIG. 10A) to overlap a portion of the second major top flap 204 when folded.

As the major top panels do not overlap one another along their lateral edges, the carton generally has a height along its perimeter that is substantially uniform. For example, the carton height (H1) near the first longitudinally extending fold line 130*a* is approximately equal to the carton height (H2) near the carton length midpoint (M), which is approximately equal to the carton height (H3) near the second longitudinally extending fold line 130*b*. In this manner the perimeter of the carton may be described as monoplanar. This is particularly useful when stacking multiple cartons on top of one another, as the edge load is uniformly distributed about the perimeter of the carton and increases the stability of the stacked cartons.

Figure 10B:
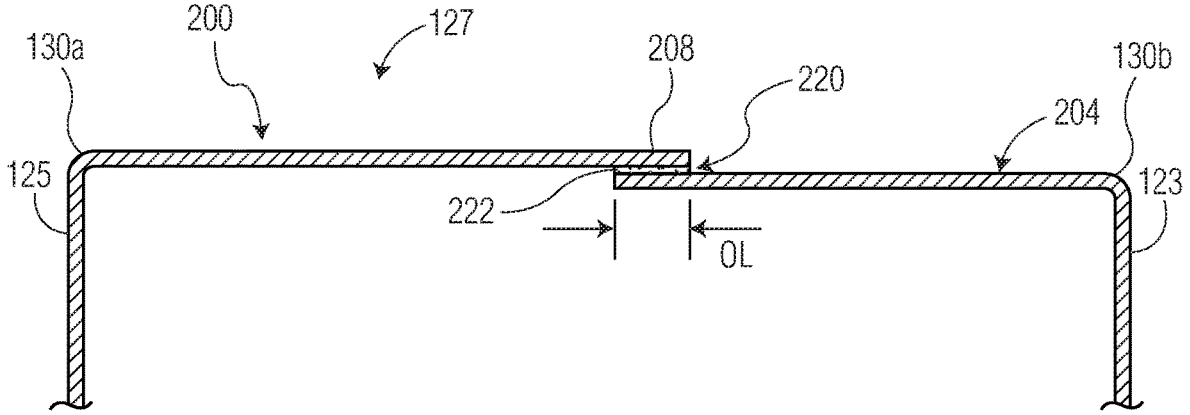
FIGS. 10B, 10C, 10D and 10E are various cross-sectional views of the carton of FIG. 10A.

With reference now to FIG. 10B, which is a cross-sectional view of the carton 100 of FIG. 10A, the tab 208 overlaps the second major flap 204 along an overlapped portion 220 and may be secured to the second major flap 204 by an adhesive 222. The overlap portion 220 has an overlap length (OL), which may be less than the tab width when the tab overlaps a recess formed in the second major flap. In certain non-limiting embodiments, the tab width (TW) may range form about 30 to about 50 mm, such as from about 35 to about 40 mm and the overlap length (OL) may range from about 5 to about 20 mm, such as from about 10 to about 15 mm.

Figure 10C:
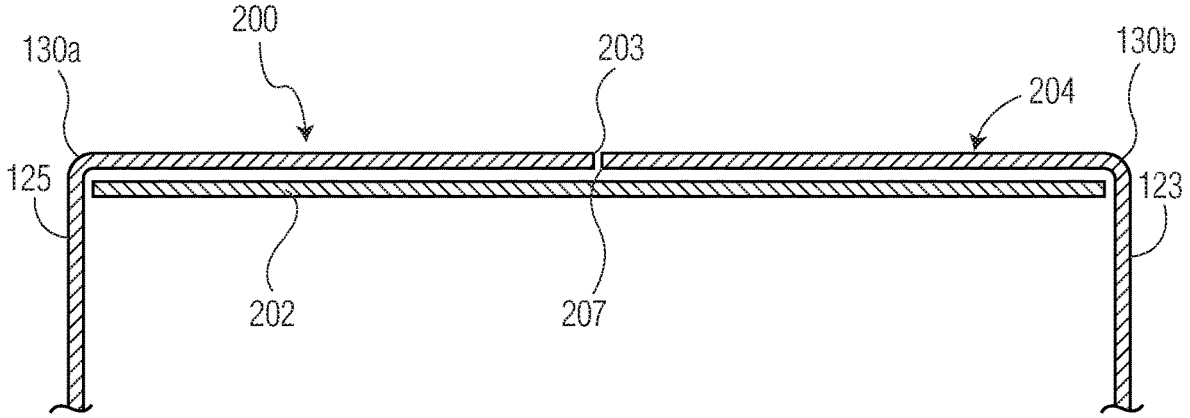

As illustrated in FIG. 10C, which is a longitudinal cross-section of the carton near its upper lateral edge, the first and second major flaps 200, 204 do not overlap one another along the lateral edge. Rather than overlap one another, the first and second major flap longitudinal edges 203, 207 may abut one another or be slightly spaced apart from one another. As further illustrated in FIG. 10C, in those instances where the first and second major flaps 200, 204 are sized such that the first and second major flap longitudinal edges 203, 207 abut one another, the first and second major flaps 200, 204 may be folded to contact the minor top flap 202 along its entire longitudinal length. In this manner, when the carton is folded closed, the folded first and second major flaps have an upper surface that is substantially monoplanar about the perimeter of the carton.

Figure 10D:
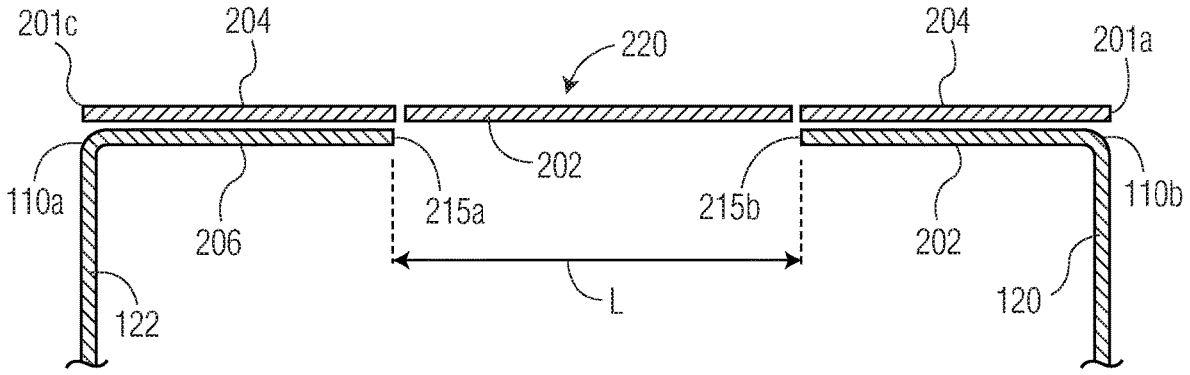

In certain embodiments, the carton's monoplanar perimeter is facilitated by, at least in-part, by the tab of one major flap extending at least partially over a recess in the opposing major flap. One embodiment of a tab/recess configuration that may result in a carton having a monoplanar perimeter is illustrated in the cross-section view of FIG. 10D. In the illustrated embodiment, the tab, which extends transversely from the major flap has a tab length (TL) that is equal to, or less than, the length of the recess (RL), which may be formed by cutting away a portion of the opposing major flap. The recess length (RL) is generally controlled by altering the length of the first and second minor top flaps 202, 206, as RL is generally the distance between the first and second minor top flap edges 215*a*, 215*b*. In this manner the tab may be received by the recess and compressed downwardly when the carton is folded closed and more particularly when closed cartons are stacked one on top of another. The ability of the tab to compress downwardly reduces the overall height of the carton top and improves the stability of multiple cartons when stacked one on top of another.

Figure 10E:
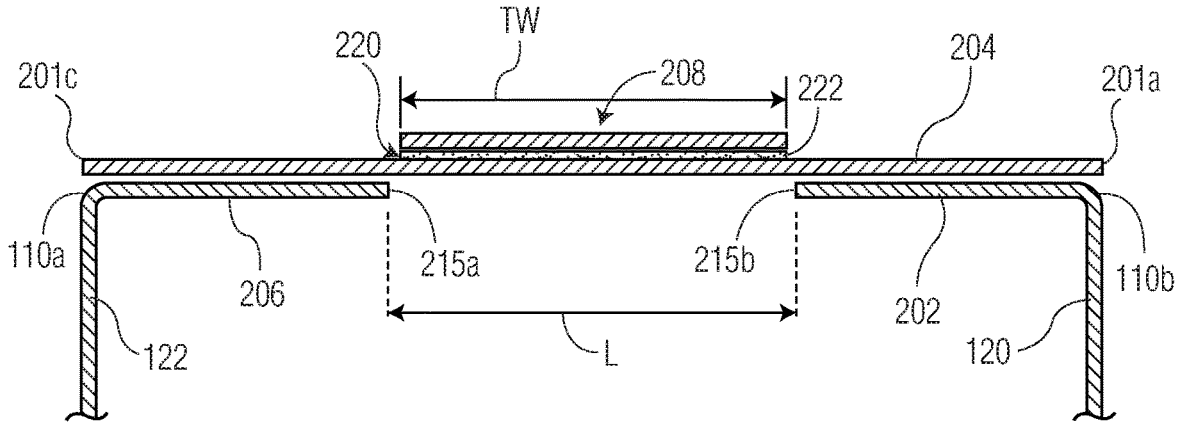

As illustrated in FIG. 10E, the tab 208 overlaps the second major top flap 204 and is attached thereto by an adhesive 222 along the overlapped portion 220. The length of the overlap portion is generally the tab length (TL), which in certain embodiments may correspond to the recess length (RL), as discussed above. While the second major top flap 204 is overlapped by the tab 208 along an overlap portion 220 the first major flap does not otherwise overlap the second major flap 204. Rather, the second major top flap 204 contacts the folded minor top flaps 202, 206 along its lateral edges 201*a*, 201*c*.

Figure 11:
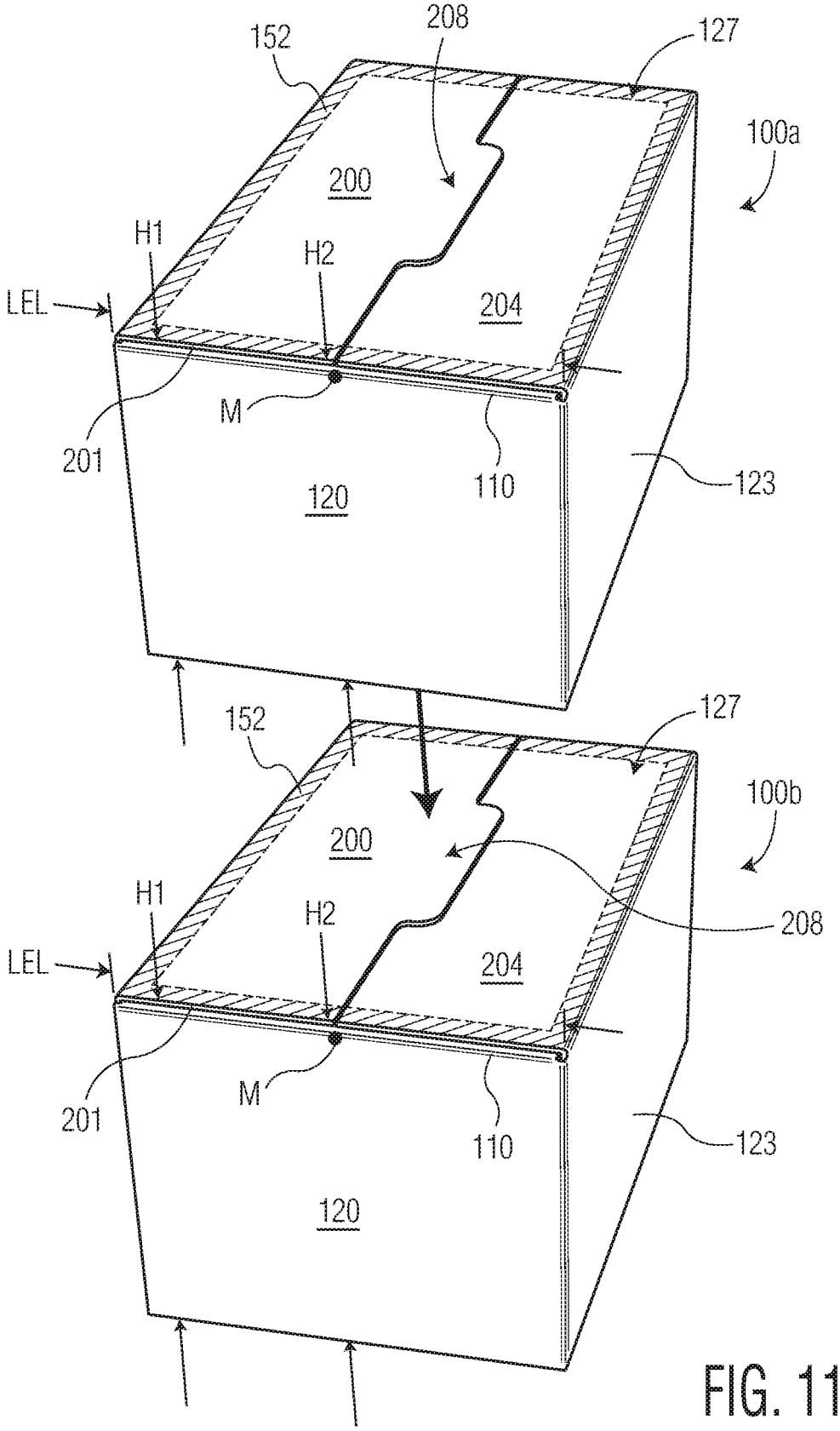
FIG. 11 is a perspective view of two cartons being stacked one on top of the other.

The advantage of the present invention is particularly apparent when multiple cartons are stacked one on top of the other, such as illustrated in FIG. 11. As shown in FIG. 11, both cartons 100*a*, 100*b* have an upper perimeter 152 (shaded portion) and folded first and second top panels 200, 204 having a lateral edge 201 that contacts the folded minor flaps along the transverse extending fold line 110 along the entire lateral edge length (LEL). In this manner the first height (H1) and the second height (H2), which is generally near the midpoint (M) of the carton, are substantially equal. Further, this configuration provides the folded first and second major flaps 200, 204 with an upper surface perimeter 152 that is substantially monoplanar. When the cartons are stacked the edge load is uniformly distributed about the perimeter of the carton and increases the stability of the stacked cartons.

The monoplanar nature of the carton perimeter is further facilitated by providing the carton with a compressible center overlapped portion. As illustrated in FIG. 11, both cartons 100 have an overlapped portion formed by a tab 208 overlapping the second major flap 204. The overlap is designed to compress on center and not to add material height to the perimeter of the carton so that the cartons may be stacked one on top of another to form a stable unit load.

What is claimed is:

1. A carton having a longitudinal dimension, a transverse dimension, opposed top and bottom panels, opposed first and second side panels, and opposed first and second end panels, the carton comprising: a first major top flap having opposed first and second lateral edges and a tab having a length dimension (TL), a width dimension (TW) and a tab area (TA), a second major top flap having first and second opposed lateral edges, and first and second minor top flaps;

wherein the first and second major flaps are foldably connected to opposed first and second end panels to form opposed folded major flap edges and the first and second major flaps further comprise first and second major flap longitudinal edges opposite of the folded major flap;

wherein the tab at least partially overlaps the second major flap along an overlap portion, the first and second major top flap lateral edges do not overlap one another; and wherein the second major top flap further comprises a recess having a recess disposed along the major flap longitudinal edge, the recess having a length dimension (RL), a width dimension (RW) and a recess area (RA), wherein RA is less than TA and the recess is at least partially overlapped by the tab.

2. The carton of claim 1 wherein the tab overlaps the second major flap to form an overlap portion having a length dimension (OL), a width dimension (OW) and an overlap portion area (OA), wherein TW is greater than RW and OA is less than TA.

3. The carton of claim 2 wherein the overlap portion area (OA) is from about 20 to about 40 percent of the tab area (TA).

4. The carton of claim 1 wherein the recess width (RW) is from 60 to about 70 percent of the tab width (TW).

5. The carton of claim 1 wherein the first and second minor flaps further comprise first and second minor flap lateral edges spaced apart from one another a distance (L), wherein L is greater than TL and L is greater than RL.

6. The carton of claim 5 wherein the tab portion and the recess each have a midpoint and the respective midpoints are equal distance between the spaced apart minor flap lateral edges.

7. The carton of claim 1 wherein the first and second minor flaps are foldably connected to opposed first and second side panels to form opposed folded minor flap edges extending the transverse length of the carton and wherein the first and second major top flap lateral edges contact the folded minor flap edge along the entire transverse length of the carton.

8. The carton of claim 1 wherein the carton has a carton height and the carton height is substantially uniform along the entire transverse length of the carton.

9. The carton of claim 1 wherein the first and second major flap longitudinal edges abut one other.

10. A carton having a bottom panel, a top panel, a top panel perimeter edge and a carton height, the carton comprising first and second major top flaps folded to form the top panel wherein the height of the carton about the entirety of the perimeter edge is substantially uniform, the first and second major top panels do not overlap one another along any portion of the perimeter edge and the first major top flap has a tab having a tab area (TA) and the second major top flap has a longitudinal edge disposed opposite a folded edge and a single recess disposed along the second major top flap longitudinal edge, the single recess having a recess area (RA) wherein TA is greater than RA and the tab entirely overlaps the recess and at least a portion of the second major top flap.

11. The carton of claim 10 wherein the tab has a length dimension (TL) and a width dimension (TW) and the tab overlaps the second major flap to form an overlap portion having a length dimension (OL), a width dimension (OW) and an overlap portion area (OA), wherein TW is greater than RW and OA is less than the tab area (TA).

12. The carton of claim 11 wherein the overlap portion area (OA) is from about 20 to about 40 percent of the tab area (TA).

13. The carton of claim 11 wherein the recess width (RW) is from 60 to about 70 percent of the tab width (TW).

14. The carton of claim 11 further comprising first and second minor flaps having first and second minor flap lateral edges spaced apart from one another a distance (L), wherein L is greater than TL and L is greater than RL.

15. The carton of claim 10 further comprising first and second minor flaps having first and second minor flap lateral edges spaced apart from one another a distance (L).

16. The carton of claim 10 wherein the bottom panel comprises a first and a second major bottom flap and wherein the first and the second major bottom flaps have a size and a shape that is substantially like the first and the second major top flaps.

17. A carton having a longitudinal dimension, a transverse dimension, opposed top and bottom panels, opposed first and second side panels, and opposed first and second end panels, the carton comprising: a first major top flap having opposed first and second lateral edges and a tab having a length dimension (TL), a width dimension (TW) and a tab area (TA), a second major top flap having, a folded edge, a longitudinal edge and first and second opposed lateral edges and a recess disposed along the longitudinal edge, the recess having a length dimension (RL), a width dimension (RW)

and a recess area (RA), and first and second minor top flaps, wherein the tab entirely covers the recess and at least partially overlaps a portion of the second major flap and wherein the first and second major top flap lateral edges do not overlap one another when the carton is in a closed configuration.

18. The carton of claim 17 wherein the recess width (RW) is from 60 to about 70 percent of the tab width (TW).

* * * * *